US009703263B2

(12) United States Patent
Durkee

(10) Patent No.: US 9,703,263 B2
(45) Date of Patent: Jul. 11, 2017

(54) FLOOR CLOCK HAVING ENHANCED INFINITY MIRROR

(71) Applicant: Douglas Durkee, Burlington, KY (US)

(72) Inventor: Douglas Durkee, Burlington, KY (US)

( * ) Notice: Subject to any disclaimer, the term of this patent is extended or adjusted under 35 U.S.C. 154(b) by 0 days.

(21) Appl. No.: 13/936,818

(22) Filed: Jul. 8, 2013

(65) Prior Publication Data

US 2015/0009665 A1 Jan. 8, 2015

(51) Int. Cl.
*G04B 47/02* (2006.01)
*G04B 45/00* (2006.01)

(52) U.S. Cl.
CPC ..... *G04B 47/02* (2013.01); *G04B 45/00* (2013.01)

(58) Field of Classification Search
CPC ..... G09F 13/12; G04B 47/02
USPC ..... 362/136, 125, 298; 40/219, 582, 564, 40/541
See application file for complete search history.

(56) References Cited

U.S. PATENT DOCUMENTS 2,132,472 A * 10/1938 En Holm ..... 40/219
2,286,247 A * 6/1942 Yearta ..... 40/219
3,593,517 A * 7/1971 Knippler ..... 368/234
4,761,004 A * 8/1988 Hargabus ..... 472/63
4,922,384 A * 5/1990 Torrence ..... 362/611
5,787,618 A * 8/1998 Mullis ..... 40/219
5,788,579 A * 8/1998 Cherry et al. ..... 472/63
5,810,465 A * 9/1998 Hargabus ..... 362/84
5,951,143 A * 9/1999 Ginsberg ..... 362/140
6,929,552 B1 * 8/2005 Hargabus ..... 472/61
8,491,149 B2 * 7/2013 Weiser ..... 362/161
8,754,595 B2 * 6/2014 Anderson ..... 315/318
2014/0293598 A1 * 10/2014 Bruck et al. ..... 362/234

FOREIGN PATENT DOCUMENTS

GB 2027969 A * 2/1980
GB 2029067 A * 3/1980
GB 1581655 A * 12/1980
GB 2058428 A * 4/1981
GB 2210490 A * 6/1989
GB 2446649 A * 8/2008

OTHER PUBLICATIONS

Wayback Machine, Applicant's Website, Dated Apr. 23, 2013, Selling Floor Clock with Infinity Mirror.*

* cited by examiner

*Primary Examiner* — Jong-Suk (James) Lee
*Assistant Examiner* — Christopher E Dunay
(74) *Attorney, Agent, or Firm* — Brinks Gilson & Lione

(57) ABSTRACT

An infinity mirror with enhanced optical effects that are created by providing auxiliary light-reflecting elements within the mirror chamber of an infinity mirror and selectively illuminating individual ones of the light sources of an infinity mirror so as to create and change the pattern of illumination.

15 Claims, 3 Drawing Sheets

FLOOR CLOCK HAVING ENHANCED INFINITY MIRROR

BACKGROUND

The present invention relates generally to enhancements to infinity mirror displays that can be used alone or in combination with other articles and according to one embodiment a floor clock having an enhanced infinity mirror.

BRIEF SUMMARY

Infinity mirrors are well known and display a static series of spaced apart point light source illuminations that are reflected back and forth internally between opposed reflected surfaces, one of which was one-way reflective surface that allows observation there through of the infinity display.

Infinity mirrors have been developed into objects of art that are designed to be hung on walls, clock faces and small tables.

The present inventor is owner of Infinity Art Furnishings, products, including infinity mirrors, of which are displayed and offered on www.infinityartfurnishings.com.

The present inventor has developed a manner in which to enhance infinity mirror displays which can be integrated into or combined with, various objects and articles, such as, but not limited to, round glass orbs with reflective surfaces and/or convex mirrors.

According to various features, characteristics and embodiments of the present invention which will become apparent as the description thereof proceeds, the present invention provides an infinity mirror that comprises:

a mirror chamber having an internally reflective back wall, an internally reflective front that provides one-way viewing into the mirror chamber, and peripheral walls extending between the back wall and front;

a series of spaced apart light sources provided within the mirror chamber along at least a portion of the peripheral walls one or more auxiliary light-reflecting elements provided within the mirror chamber; and an electronic circuit that selectively illuminates individual ones of the series of light sources in a desired pattern.

The present invention further provides an improvement for infinity mirrors which improvement comprises providing one or more auxiliary light-reflecting elements in said mirror chamber.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

Figure 1:
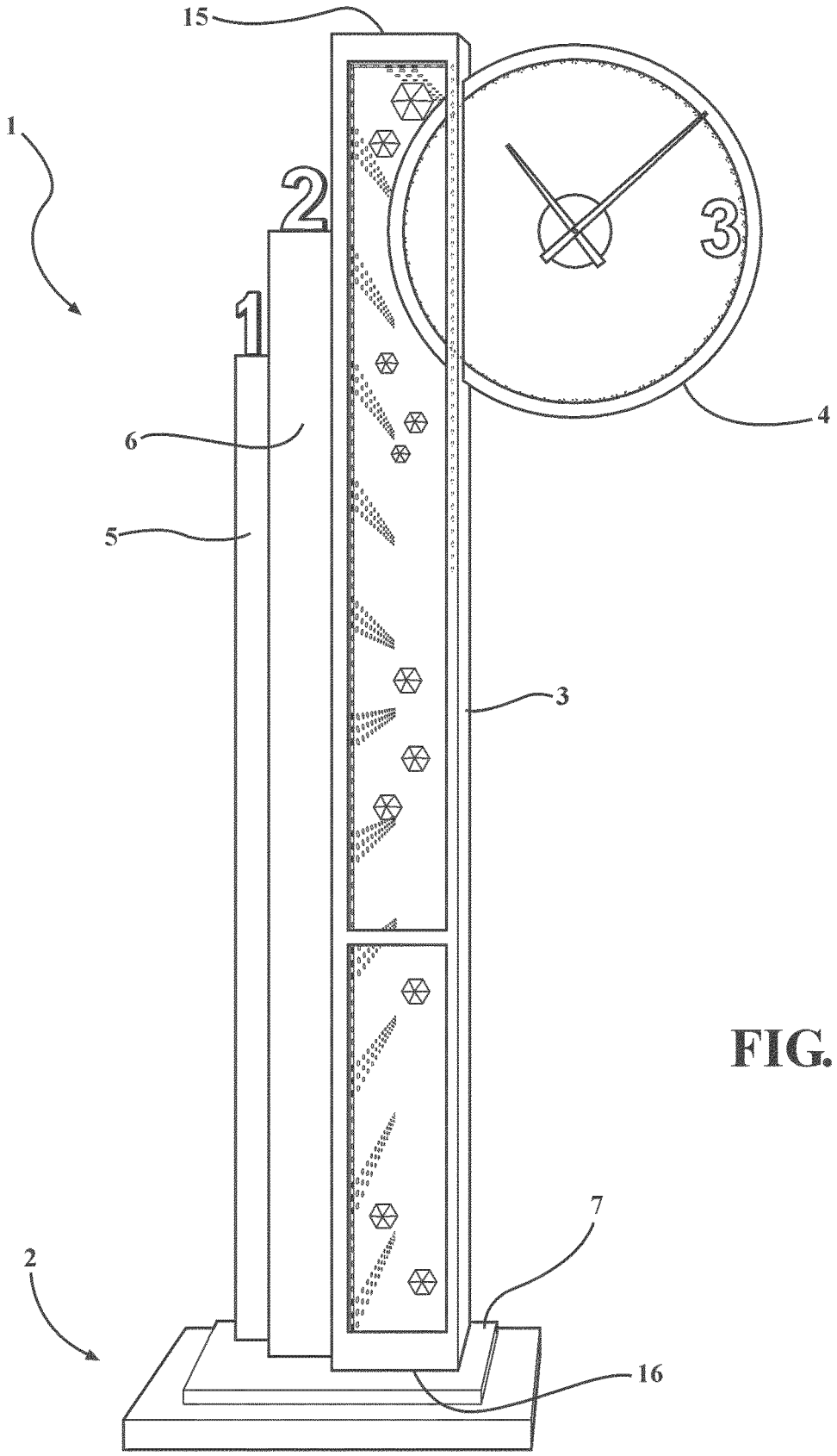
FIG. 1 is a front view of an enhanced infinity mirror in combination with a floor clock according to one embodiment of the present invention.

The present invention relates generally to enhancements to infinity mirror displays that can be used alone or in combination with other objects or articles. According to one embodiment the enhancements include sequencing the illumination of the light sources and/or including and sequencing the illumination of light sources that have different colors.

According to another embodiment the enhancements include providing additional light-reflecting objects or elements within the chamber of an infinity mirror. Such light reflecting objects can include objects that have flat light-reflecting surfaces such as mirrors or mirrored surfaces. In other embodiments the additional light-reflecting objects can be three-dimensional objects that have light-reflecting surfaces, including multiple flat surfaces, non-flat surfaces or combinations thereof. In other embodiments non-reflecting objects are provided in the mirror chamber so that the illuminated images of the non-reflecting objects are reflected in the mirror chamber. In further embodiments the reflective back of the mirror is provided with transparent portions that are backlight to display symbols, logos, trademarks, etc.

The enhanced infinity mirror displays of the present invention include a chamber having opposed front and back surfaces that repeatedly reflect light back and forth, and a series of spaced apart light sources mounted along at least part of the periphery of the chamber defined by the sides, top and bottom within the chamber, in a conventional manner according to conventional infinity mirrors.

According to the present invention the series of spaced apart light sources (such as LED's) are connected to a suitable electric control circuit and configured to be sequentially or non-sequentially illuminated according to any desired pattern that can be varied and changed as desired. For example the individual light sources can be illuminated to produce the illusion of a chasing light pattern. Otherwise individual lights that have different colors can be used in the series of light sources and selectively illuminated to change the color of any desired illumination pattern. As described herein it is to be understood that the series of light sources can be illuminated in any desired pattern as opposed to being illuminated in a static pattern that does not change. The electric control circuitry can include a remote control unit that a user can use to control the pattern, color, sequencing, etc. of the series of spaced apart light sources remotely.

Whereas the series of light sources are arranged in the chamber along at least a portion of the peripheral of the mirror chamber as noted above and conventional in infinity mirrors, the additional light-reflecting objects (also referred hereinto as "auxiliary light-reflecting objects" or "auxiliary light-reflecting elements") can be positioned and mounted anywhere within the mirror chamber, including on any of the interior surfaces or on supports such as posts, brackets, etc. that are mounted on any of the interior surfaces of the chamber.

Figure 4:
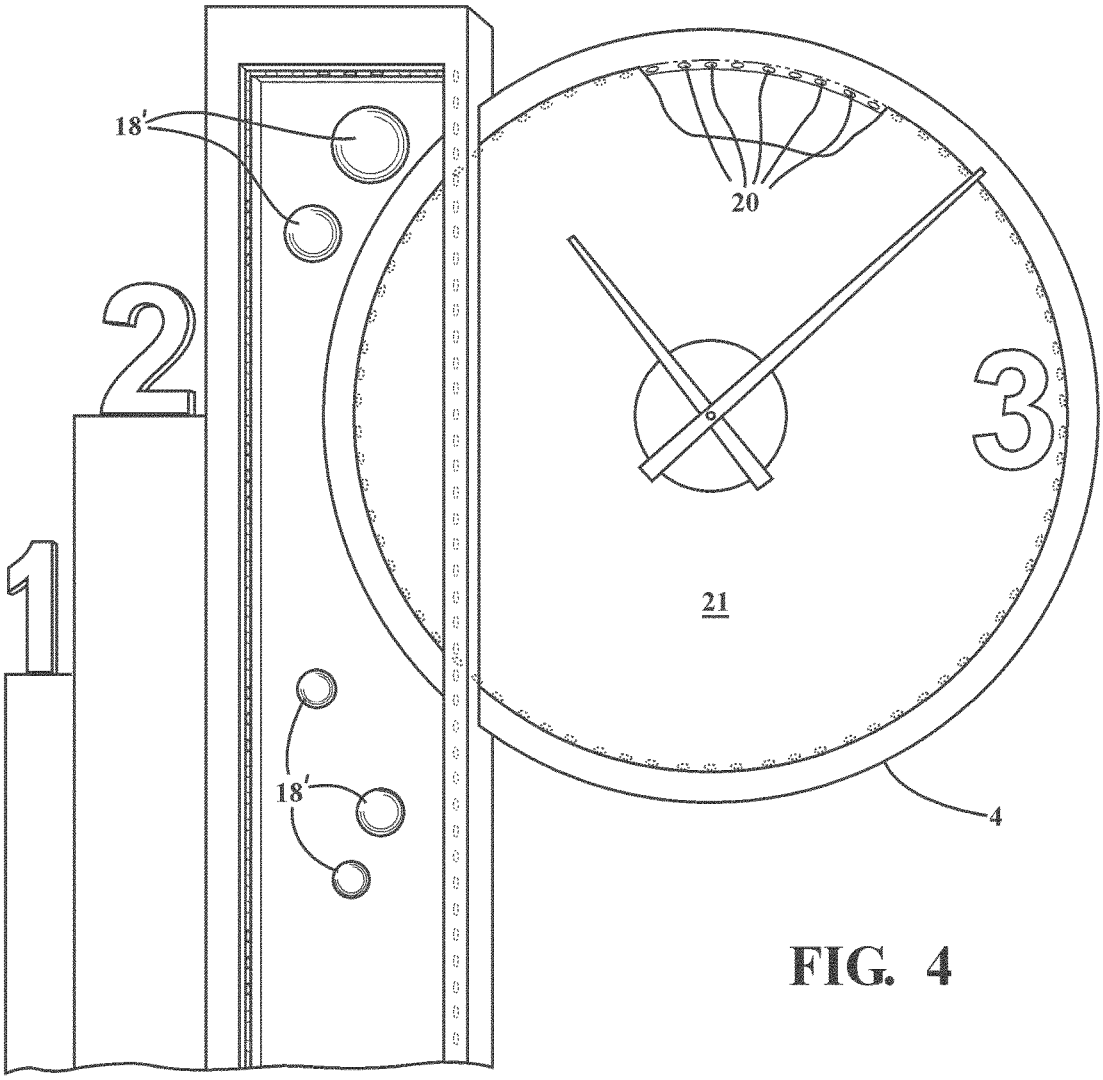
FIG. 4 is an enlarged view of a top portion of the floor clock of FIG. 1 according to an embodiment in which the auxiliary light-reflecting elements or objects are reflective spheres.

The auxiliary light-reflecting elements can be discrete flat mirrors or similar flat light-reflecting surfaces of the same or different shapes and sizes. Alternatively the auxiliary light-reflecting elements can be three-dimensional objects of the same or different shapes or sizes that have mirrored or other types of light-reflecting surfaces. Examples of three-dimensional light-reflecting elements or objects include orbs or spheres (see FIG. 4), cylinders, cones, multifaceted objects or three-dimensional objects having any combination of curved and/or flat surfaces that are light-reflecting. Tinted or colored light-reflecting surfaces can be provided on the auxiliary light-reflecting elements if desired According to the present invention the auxiliary light-reflecting objects reflect light that is emitted from the series of spaced apart light sources. Thus when a different one of the individual light sources is illuminated the angle of incidence and reflectance changes creating the illusion of movement.

FIG. 1 is a front view of an enhanced infinity mirror in combination with a floor clock according to one embodiment of the present invention. The floor clock 1 depicted in FIG. 1 includes a base 2, an infinity mirror chamber 3, a circular clock 4 and columns 5 and 6.

The base 2 which supports the infinity mirror chamber 3 and columns 5 and 6 is depicted as having a rectangular shaped footprint with a stepped upper platform 7. The base 2 is sized to provide sufficient support and stability to the floor clock 1. In alternative embodiments the base 2 can have a footprint that is rectangular, circular, polygonal, geometric, non-geometric, etc. as desired. The base 2 can be stepped or non-stepped and have any desired height. In alternate embodiments the base 2 can comprise the bottoms of columns 5 and 6 and the bottom of the infinity mirror chamber.

Figure 2:
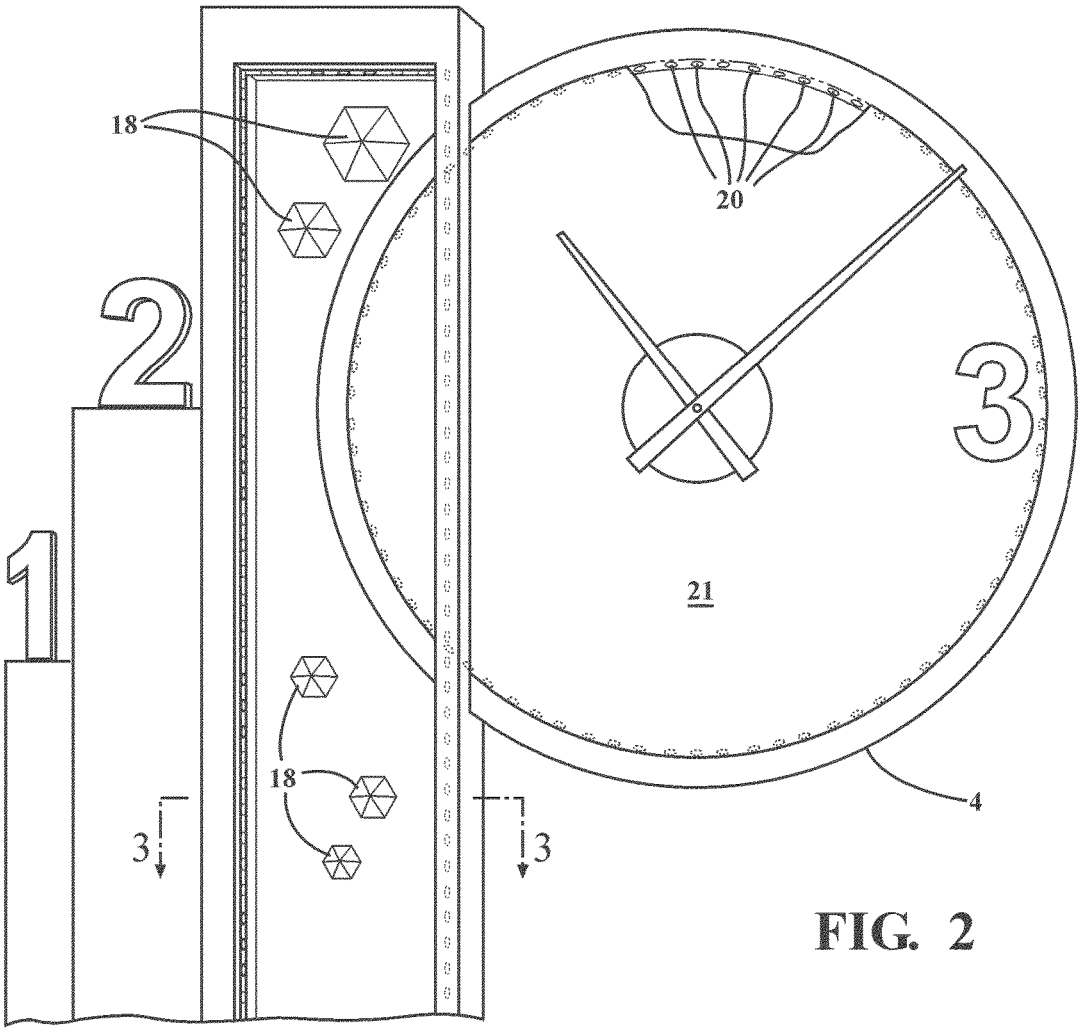
FIG. 2 is an enlarged view of a top portion of the floor clock of FIG. 1.

FIG. 2 is an enlarged view of a top portion of the floor clock of FIG. 1.

Figure 3:
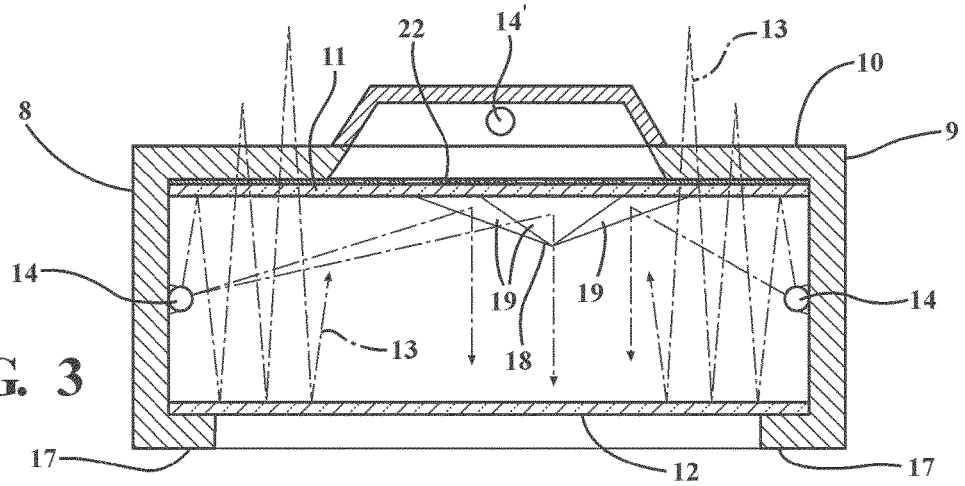
FIG. 3 is a cross-sectional view taken along section lines 3-3 in FIG. 2 which depicts how light is reflected internally within the chamber of the enhanced infinity mirror.

FIG. 3 is a cross-sectional view taken along section lines 3-3 in FIG. 2 which depicts how light is reflected internally within the chamber of the enhanced infinity mirror.

As depicted in FIG. 3 the infinity mirror chamber 3 includes a pair of opposed side walls 8 and 9 and a back wall 10 that is provided with a reflective surface 11 that reflects light. The reflective surface 11 can be a mirror or a mirrored surface formed by any known manner, including but not limited to a applying a reflective film to the back wall 10. The front wall 12 of the mirror chamber 3 reflects light internally as indicated by broken lines 13, while providing for one-way viewing into the mirror chamber 3, in a manner that is conventional for infinity mirrors.

A series of light sources 14 are provided within the mirror chamber 3 along the opposed side walls 8 and 9 and top 15 and bottom 16. As depicted in FIG. 3 the series of light sources 14 are located behind peripheral edges 17 of front chamber frame elements that can be provided to conceal direct visual observation of the light sources 14 (but not visual observation of the internal reflected images of the light sources). The broken lines 13 in FIG. 3 depict how the reflected images of the light sources 14 are reflected back and forth between the reflective back of the mirror chamber 3 and the one-way reflective front of the mirror chamber 3.

The mirror chamber 3 of the present invention includes a plurality of auxiliary light-reflecting elements 18. As noted above these auxiliary light-reflecting elements 18 can be discrete flat mirrors or similar flat light-reflecting surfaces. Alternatively the auxiliary light-reflecting elements 18 can be three-dimensional objects. In the embodiment shown, the auxiliary light-reflecting elements 18 are three-dimensional faceted hexagonal pyramids that comprise mirror facets 19.

The auxiliary light-reflecting elements 18 are positioned on the back wall 11 of the mirror chamber 3 as depicted in FIG. 3 and throughout the mirror chamber 3 as depicted in FIGS. 1 and 2.

As shown in FIG. 3 the auxiliary light-reflecting elements 18 reflect light from the series of light sources 13 outward through the one-way reflective front of the mirror chamber 3. As can be appreciated each facet 19 of the auxiliary light-reflecting elements 18 will reflect light at a different angle.

According to the present invention the series of light sources 14 are selectively illuminated in any desired pattern. For example the individual light sources can be illuminated to produce the illusion of a chasing light pattern. Otherwise individual lights that have different colors can be used in the series of light sources 14 and selectively illuminated to change the color of any desired illumination pattern. As described herein it is to be understood that the series of light sources can be illuminated in any desired pattern as opposed to being illuminated in a static pattern that does not change. Further the illumination pattern can be programmed to speed up, slow down or change in any desired manner.

When faceted auxiliary light-reflecting elements 18 are used and different ones of the series of light sources 14 are selectively illuminated the angle of each illuminated light source reflected by the auxiliary light-reflecting elements 18 changes. The resulting visual effect is movement of the illumination pattern reflected by the auxiliary light-reflecting elements 18. When the individual ones of the series of light sources 14 are sequentially illuminated the visual effect can be a rotating visual illusion. Changing the direction of the sequential illumination of the individual one of the series of light sources 14 will result in a change in spinning direction of the visual illusion.

As can be appreciated by providing any number of auxiliary light-reflecting elements, having flat and/or any three-dimensional shape and changing the illumination sequence or pattern of the series of light sources 14 and/or the colors of light sources that are illuminated there is virtually an unlimited number of visual effects that can be created and displayed.

Whereas the auxiliary light-reflecting elements 18 are depicted as being attached to the reflective back of the mirror chamber 3 in FIGS. 1-3, it is to be understood that the auxiliary light-reflecting elements 18 can be supported on any of the interior surfaces or on supports such as posts, brackets, etc. that are mounted on any of the interior surfaces of the mirror chamber 3.

Further whereas faceted auxiliary light-reflecting elements 18 are depicted in the drawings, it is to be understood that the auxiliary light-reflecting elements 18 can be flat mirror or mirrored surfaced elements that are fixed at any desired angle, or three-dimensional elements that include multiple flat surfaces, non-flat surfaces or any combination of flat and non-flat surfaces. In this regard the auxiliary light-reflecting elements 18 can be flat or have three-dimensional shapes that are circular, polygonal, geometric, non-geometric, etc. as desired.

According to further embodiments of the present invention the auxiliary light-reflecting elements can be mounted on supports that allow them to be individually rotated.

According to further embodiments of the present invention the auxiliary light-reflecting elements can be mounted on supports that allow the auxiliary light-reflecting elements to move. For example one or more of the auxiliary light-reflecting elements can be mounted non-coaxially on a rotating support or on a track or rail.

In further embodiments of the present invention any one of a variety of objects can be positioned in the mirror chamber so that such object(s) will be illuminated by the series of light sources and the illuminated image of the object(s) will be reflected between the reflective surface 11 of the back wall 10 and the front wall 12 and off any auxiliary light-reflecting elements 18. For example a manufacture could place one or more of their products or small replicas of their products in a mirror chamber of the present invention to display the reflected images of such products. Similarly a service provider could place one or more objects related to their service in a mirror chamber of the present invention to display the reflected images of such object(s). Objects could include three-dimensional logos, initials, company names or symbols, etc. Such objects can be positioned and mounted anywhere within the mirror chamber, including on any of the interior surfaces or on supports such as posts, brackets, etc. that are mounted on any of the interior surfaces of the chamber. Such objects can be referred to herein as being non-reflective to differentiate them from the auxiliary light-reflecting elements 18. In further embodiments such objects could be internally illuminated.

In a further embodiment of the present invention depicted in FIG. 3 a portion or portions 22 of the reflective surface 11 of the back wall 10 could be made transparent so as to allow light to pass therethough. For example in the case of using a mirror as the reflective surface 11 a symbol, character, logo, trademark, etc. could be formed by selectively removing a portion of the mirror surface (i.e., mirror silvering) by sandblasting, physical etching (including grinding), chemical etching or the other suitable manner.

The resulting transparent symbol, character, logo, trademark, etc. could be backlight to display the symbol, character, logo, trademark, etc. Such backlighting could include changing the color of the symbol, character, logo, trademark, etc. as desired and/or sequencing the backlighting as desired by a light source 14'.

In further embodiments the reflective surface 11 of the back wall 10 could be a one-way mirror (or film) with the reflecting surface directed into the mirror chamber. In this embodiment an illuminated symbol, character, logo, trademark, etc. can be provided behind the reflective surface 11 so that the illuminated symbol, character, logo, trademark, etc. would project through the one-way mirror (or film). The color of the illuminated symbol, character, logo, trademark, etc. could be change as desired and sequenced as desired.

The floor clock shown in FIGS. 1-3 includes a circular clock 4 that is configured to intersect an upper side of the mirror chamber 3. A cut-away portion of the clock 4 shows that there is a series of light sources 20 provided around the inner periphery of the clock 4. The clock face 21 is made from a material that diffuses the light emitted from the series of light sources 20. The illumination of the series of light sources 20 can be controlled as desired by the electronic circuit as noted above. For example the series of light sources 20 can be illuminated in a sequential manner that is similar to that of the series of light sources 14 of the mirror chamber, or illuminated in a sequentially opposite direction or rotation. As in the case of the series of light sources 14 of the mirror chamber, the series of light sources 20 can include different colored light sources that can be controlled to change the color of the clock 4.

The columns 5 and 6 extend along the side of mirror chamber 3 and, in the illustrated embodiment, include three-dimensional numerals on their tops.

While the figures are directed to a floor clock that includes an enhanced infinity mirror, it is to be noted that the enhanced infinity mirror of the present invention can be used alone without the clock 4 or columns 5 and 6. In this regard the enhanced infinity mirror can be any shape (not necessarily rectangular) and provided as standalone art object that can be hung on a wall or mounted on some other support. Alternatively the enhanced infinity mirror can be incorporated into a table such as a coffee table, end table, etc. as conventional infinity mirrors are known to be used. Further the enhanced infinity mirrors of the present invention can be combined and incorporated into articles or structures that include clocks, clock faces, regular mirrors, windows, cabinets, entertainment units that are configured to include televisions and/or audio systems, building structures including walls, ceilings, floors, or virtually any desired component or structure.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. An infinity mirror that comprises:

a mirror chamber having an internally reflective back wall, an internally reflective front that provides one-way viewing into the mirror chamber, a top, a bottom, peripheral walls extending between the back wall and front, and front chamber frame elements that extend over peripheral edges of the internally reflective front;

a series of light sources provided within the mirror chamber which series of light sources extend in an alignment that extends along at least a length of the peripheral walls which length extends from and between the top and the bottom of the mirror chamber, the series of light sources being located behind the front chamber frame elements so as to conceal the series of light sources from direct observation;

one or more auxiliary light-reflecting elements provided within the mirror chamber, each of the one or more auxiliary light-reflecting elements comprising a mirror or mirrored surface that reflects light emitted from the series of light sources; and an electronic circuit that selectively illuminates individual ones of the series of light sources in a desired sequential pattern around an internal peripheral portion of the mirror chamber.

2. An infinity mirror according to claim 1, wherein the one or more auxiliary light-reflecting elements comprise flat light-reflecting elements.

3. An infinity mirror according to claim 1, wherein the one or more auxiliary light-reflecting elements comprise three-dimensional light-reflecting elements.

4. An infinity mirror according to claim 1, wherein the one or more auxiliary light-reflecting elements are attached to at least one of the reflective back wall or the peripheral walls of the mirror chamber.

5. An infinity mirror according to claim 4, wherein the one or more auxiliary light-reflecting elements are mounted on supports.

6. An infinity mirror according to claim 3, wherein the three-dimensional light-reflecting elements include facets.

7. An infinity mirror according to claim 3, wherein the three-dimensional light-reflecting elements comprises non-faceted reflective surfaces.

8. An infinity mirror according to claim 1, wherein the series of light sources comprises light sources that emit different colors of light and the electronic circuit selectively illuminates individual ones of the series of light sources that emit different colors of light to change the color of light emitted and the pattern of light emitted.

9. An infinity mirror according to claim 1, further comprising one or more non-reflecting elements provided within the mirror chamber and arranged so that images of said non-reflecting elements reflect between the internally reflective back wall and the internally reflective front of the mirror chamber.

10. An infinity mirror according to claim 1, wherein a portion of internally reflective back wall is transparent and backlit.

11. An infinity mirror according to claim 1 in combination with a clock.

12. The combination of claim 11, wherein the clock comprises a clock face that is illuminated by a series of internal light sources.

13. The combination of claim 12, wherein the electronic circuit selectively illuminates individual ones of the series of light sources within the mirror chamber and individual ones of the series of light sources of the clock face.

14. An infinity mirror according to claim 1, wherein the opposed reflective surfaces include a reflective front and a reflective back surface and a portion of the reflective back wall is transparent and backlit.

15. An infinity mirror according to claim 1, wherein the auxiliary light-reflecting elements comprise mirrors.

* * * * *